US005370032A

United States Patent [19]

Reuche et al.

[11] Patent Number: 5,370,032

[45] Date of Patent: Dec. 6, 1994

[54] HOUSING FOR PROPELLANT CHARGE

[75] Inventors: Marc Reuche, La Chapelle Saint Ursin; Bruno C. Lang, Bourges, both of France

[73] Assignee: Luchaire Defense SA, Versailles, France

[21] Appl. No.: 139,771

[22] Filed: Oct. 22, 1993

[30] Foreign Application Priority Data

Oct. 22, 1992 [FR] France ..... 92 12643

[51] Int. Cl.[5] ..... F41A 1/10

[52] U.S. Cl. ..... 89/1.701

[58] Field of Search ..... 89/1.701, 1.702, 1.703, 89/1.704, 1.705, 1.706

[56] References Cited

U.S. PATENT DOCUMENTS

| | | | |
|---|---|---|---|
| 1,108,717 | 8/1914 | Davis | 89/1.701 |
| 2,925,014 | 2/1960 | Abramson | 89/1.701 |
| 3,216,323 | 11/1965 | Wengenroth et al. | 89/1.701 |
| 3,279,319 | 10/1966 | Semonian et al. | 89/1.701 |
| 3,800,656 | 4/1974 | Schnäbele | 89/1.701 |
| 4,676,136 | 6/1987 | Kälin | 89/1.701 |

FOREIGN PATENT DOCUMENTS

| | | |
|---|---|---|
| 619616 | 4/1927 | France . |
| 2576682 | 8/1986 | France . |
| 806194 | 12/1958 | United Kingdom . |
| 2183800A | 6/1987 | United Kingdom . |
| WO92/06344 | 4/1992 | WIPO . |

*Primary Examiner*—David Brown
*Attorney, Agent, or Firm*—Oliff & Berridge

[57] ABSTRACT

A housing has a scored cylindrical casing that is designed to slidably fit into the barrel of a weapon and that is delimited by two side walls. After the casing breaks, due to the pressure of gases generated by a propellant charge, the housing is divided into at least two parts that are free to move relative to each other. Each housing part carries one casing element, ensuring gas tightness.

23 Claims, 6 Drawing Sheets

HOUSING FOR PROPELLANT CHARGE

BACKGROUND OF THE INVENTION

The present invention relates to housings designed to contain a propellant charge and designed to be loaded into the barrel of a recoilless weapon.

Such housings, more commonly called cartridges, ensure maintenance and initial confinement of the propellant charge. In general, they have two sabots, adjusted to the inside diameter of the barrel and connected by a rod that breaks at a very specific pressure value. The sabots are pushed in opposite directions, one carrying a projectile and the other carrying a counterweight. French Patent No. 2576682 describes such a type of housing.

In configurations of this type, gas leakages frequently occur between the sabot and the barrel. Supplementary seals are required, therefore, rendering the housing more complex and expensive and making it more difficult to mount.

WO 92/06344 describes a propellant charge housing composed of two essentially identical half-housings, assembled by a link that is fragmentable by gas pressure. Such a housing, however, also has drawbacks. First, reproducing the mechanical strength of the breaking means, that is, the link, is difficult (e.g. when attaching the half-housings by gluing). Second, assembling the housing is complex in implementation.

SUMMARY OF THE INVENTION

To overcome the above and other disadvantages, a housing according to the invention, containing a propellant charge and loaded into the barrel of a recoilless weapon, is simple in design and yet ensures gas-tight sealing without the addition of supplementary seals. Housing breakage characteristics, depending only on the geometry and material of the housing, can be effectively controlled and reproduced.

BRIEF DESCRIPTION OF THE DRAWINGS

The invention will be better understood by reading the below detailed description of preferred embodiments, which description refers to the attached drawings, wherein.

DETAILED DESCRIPTION OF PREFERRED EMBODIMENTS

Figure 1:
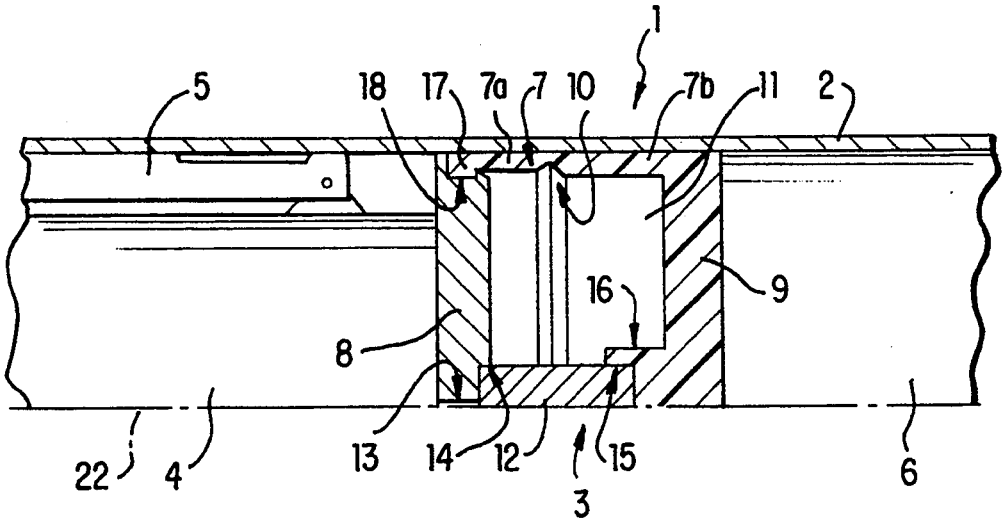
FIG. 1 is a partial schematic half cross-sectional view of a recoilless weapon including a housing according to the invention.

A housing according to the invention is designed to contain a propellant charge and to be loaded into the barrel of a recoilless weapon. The housing has a cylindrical casing, which is designed to fit slidably into the barrel of the weapon and which is delimited by two side walls. The cylindrical casing is made in one piece and has at least one annular score. After the casing has been broken by the pressure of gases generated by the propellant charge, the housing is divided into at least two elements, which are free to move relative to each other. Each element carries one part of the casing, ensuring gas tightness.

One advantage of such an arrangement is that the breakage characteristics of the housing, which then depend only on the geometry and choice of material of the housing, may be controlled. The breakage characteristics of the housing proposed by the invention are, therefore, unaffected by the assembly quality of two half-housings (such as the gluing proposed by WO 92/06344), the strength of which assembly is also likely to vary with time and the storage conditions.

Another advantage of such an arrangement is that the gas pressure applies the housing casing against the internal surface of the barrel before the casing separates into two parts. The degree of tightness thus obtained is excellent.

According to one embodiment of the invention, the cylindrical casing has two scores, each disposed in the vicinity of a different side wall. Breakage characteristics of the housing can be controlled, with respect to gas pressure, even in the case where the housing has a substantial length. Because each score is located in the vicinity of a different side wall, the length of the casing portion located between the score and the side wall can be relatively short, which reduces the frictional forces of the casing against the weapon barrel. Advantageously, the locations of the scores are chosen such that on the casing they delimit a front part and a rear part with substantially equal lengths.

According to another characteristic of the invention, at least one side wall is constituted by a lid, rendered integral with the casing by a link. This characteristic allows the rigidity of the side wall to be easily increased, as it must both withstand the pressure of the gases and transmit thrust forces to the projectile or the counterweight. It also allows for easy assembly and loading of the housing. The casing, fitted with the side wall, can thus receive an igniter and the propellant charge, with the lid then being set in place to close the housing.

According to another embodiment, the lid has a peripheral recess into which fits an internal shoulder of the casing, which shoulder and recess ensure attachment between the casing and the lid. According to another embodiment, a side wall is formed in one piece with the casing. This wall is preferably the wall in the vicinity of the counterweight. Such an arrangement facilitates the mounting of the housing.

According to particular embodiments, the lid can be formed by a rear part of the projectile, the score can result from thinning of the cylindrical casing, and the housing has a compressible foam cup designed to wedge the propellant charge. Preferably, the casing is made of a flexible plastic material with a high elongation factor and a low coefficient of friction.

The propellant charge is preferably triggered by the igniter, which is located inside the housing at its axis and which fits into at least one recess provided in a side wall. This arrangement facilitates assembly of the housing and allows igniter wires to exit through an orifice on an axis of the housing, preferably in the lid.

According to another embodiment, the housing is designed to contain a propellant charge and to be installed in a barrel of a recoilless weapon, and is made of two half-housings, each having a cylindrical casing designed to fit slidably in the weapon barrel. The casings each have a side wall and an annular score. After the scores have broken under the effect of the pressure of gases generated by the propellant charge, the housing is divided into at least two elements that are free to move with respect to each other. Each element carries part of the casing, ensuring gas tightness. This embodiment allows very light housings to be obtained.

FIG. 1 shows the median part of recoilless weapon 1, schematically in half-cross section. Weapon 1 has cylindrical barrel 2, made, for example, with wound filaments, and has axis 22. Projectile 4, housing 3, which contains a propellant charge, and counterweight 6 are disposed within barrel 2. These elements are symmetrically disposed about housing axis 22.

Counterweight 6 is formed, for example, by a bundle of plastic filaments that are designed to separate when they exit barrel 2.

Projectile 4 has stabilizer fins 5 at its rear part. Fins 5 are folded inside barrel 2 and deploy when projectile 4 exits barrel 2.

Housing 3 has cylindrical casing 7, which fits slidably in barrel 2. Casing 7 is closed by two lateral walls. A first lateral wall, hereinafter called bottom wall 9, is integrally formed in a single piece with casing 7. Lid 8 forms a second lateral wall.

Casing 7 and bottom wall 9 are made of a flexible plastic with a high elongation factor (approximately 600% to 900%) and a low friction coefficient (for example, a static friction coefficient on dry steel of between 0.15 and 0.25). The casing can be made of polyethylene, for example. Lid 8 is preferably made of aluminum alloy, but could also be made of plastic. Making lid 8 of metal ensures good mechanical strength with a simple geometric shape (cylindrical). Good mechanical strength is important for allowing projectile 4 to be ejected with no gas leakage.

Casing 7 has internal shoulder 17 at its opening. Shoulder 17 is designed to fit into peripheral recess 18 in lid 8. Housing 3 delimits an internal space 11, which is designed to receive a propellant charge of a known type, for example a single-base or dual-base flaky powder.

Igniter 12, preferably using black powder of a known type, is disposed in space 11 at axis 22 of the weapon and the housing. Igniter 12 fits into first recess 14 provided on lid 8 and rests in second recess 15 made on cylindrical extension 16 of bottom wall 9 of housing 3.

Igniter 12 is preferably connected by wires (not shown) to a triggering device (not shown) that is integral with weapon 1. The wires exit housing 3 through orifice 13 provided in lid 8.

Lid 8 allows igniter 12 to be rigidly attached, ensuring good resistance to vibrations.

At its median part, casing 7 has an annular score 10, which is triangular in shape. It delimits two parts on cylindrical casing 7: a front part *7a*, which abuts lid 8, and a rear part *7b*, which abuts bottom wall 9. As shown in FIG. 1, for example, casing 7 is of minimum thickness at score 10. Further, because casing 7 is formed of one piece, casing 7 extends continuously across score 10, that is, from one side of score 10 to the other side.

Casing 7 is elastically deformable to allow mounting of lid 8 thereon. Lid 8 is positioned at the opening of casing 7, inside of which the propellant charge and igniter 12 have been placed, and is then applied firmly against the casing. The elasticity of casing 7 ensures that shoulder 17 is correctly placed in recess 18, preventing any subsequent separation of lid 8 and casing 7.

The operation of housing 3 according to the invention is as follows:

Triggering igniter 12 sets off the propellant charge filling internal space 11. Pressure builds up inside housing 3, applying casing 7 firmly against the internal surface of barrel 2. Pressure is also applied to lid 8 and to bottom wall 9, generating a pulling force inside casing 7. When this force reaches the strength limit of housing 3, casing 7 divides into two pieces at score 10.

Figure 2:
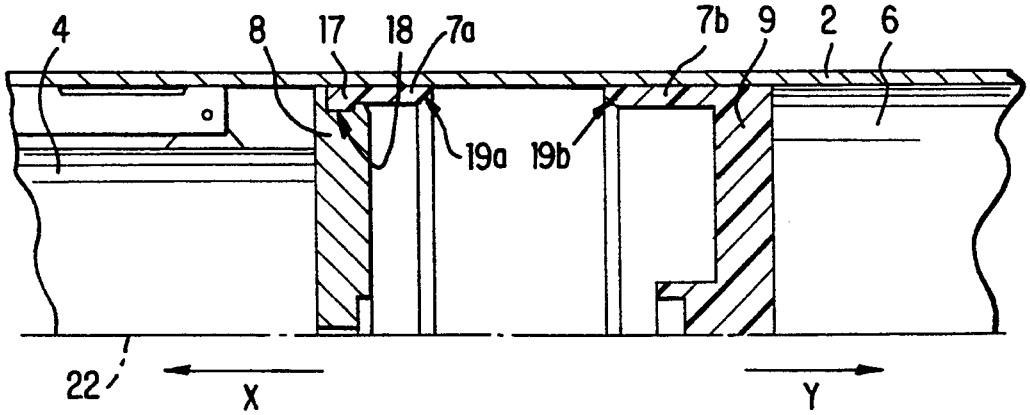
FIG. 2 is a view of the FIG. 1 device after triggering a propellant charge.

FIG. 2 shows weapon 1 at the moment of this separation. Igniter 12 is no longer shown, as its component parts have been fragmented by the pressure. The gas pressure urges projectile 4 in direction X by means of lid 8, which carries front part *7a* of casing 7 with it. The pressure also urges counterweight 6 in direction Y by means of bottom wall 9, which is integral with rear part *7b* of casing 7. The gas pressure is exerted radially on parts *7a*, *7b* of casing 7 and hence firmly applies parts *7a*, *7b* against the internal surface of barrel 2.

Thus, after separation of housing 3, each part *7a*, *7b* of casing 7 provides a seal against the propellant gases by preventing them from traveling toward projectile 4 or toward counterweight 6.

Because of the triangular shape of score 10, front part *7a* and rear part *7b* have lips 19*a*, 19*b*, respectively. The gas pressure is also applied to lips 19*a*, 19*b*, which improves the seal obtained.

In prior art housings, the gas pressure was exerted between the barrel and the housing as soon as the propellant charge was ignited and well before separation of the two parts of the housing. According to the invention, on the other hand, separation of front and rear parts *7a*, *7b* of housing 3 occurs only after pressure has applied casing 7 against the internal surface of barrel 2. The degree of tightness thus obtained with the housing according to the invention is superior to that obtained with the housing of the prior art. It is no longer necessary, therefore, to provide additional seals.

Figure 3:
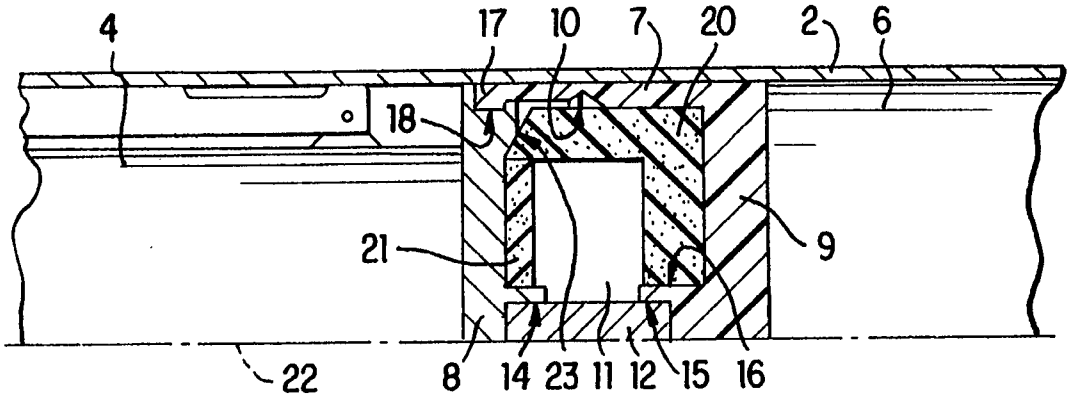
FIG. 3 is a partial schematic half cross-sectional view of a recoilless weapon including another housing embodiment according to the invention.

FIG. 3 shows an embodiment of housing 3 in which wedging cup 20, preferably made of polystyrene foam, is disposed in the housing. Cup 20 rests on bottom wall 9 and is fitted both to the internal surface of casing 7 and to cylindrical extension 16. Conical end 23 of cup 20 rests on a support of matching shape provided on lid 8. Foam washer 21 rests both on lid 8 and on cup 20.

Cup 20 and washer 21 wedge the propellant charge. In addition, they delimit a small internal space 11 for loading the charge. This space increases, however, as the gas pressure increases. Thus, given a particular housing size, the ballistic performance of the propellant charge can be made to vary.

Alternatively, it is possible to place the entire propellant charge in a sheath that also contains the igniter. The sheath rests both on lid 8 and on bottom wall 9 and has essentially the same shape as igniter 12 of FIG. 1. Such an arrangement allows the maximum pressure value to be limited when the charge is ignited.

Other variants are possible without departing from the framework of the invention. For example, it is possible to have other shapes for score 10. Score 10 also could be provided on the outer surface of the housing. Score 10 can be formed by embrittling the casing, for example by local heating or by a sudden change in cross section. It is also possible to create a bottom wall that is not made in one piece with casing 7. A bottom wall analogous to lid 8, for example, could be used. Finally, it is possible to join casing 7 to lid 8 by linking means other than fitting a shoulder into a recess. Threading means or gluing, for example, could be used.

Figure 4:
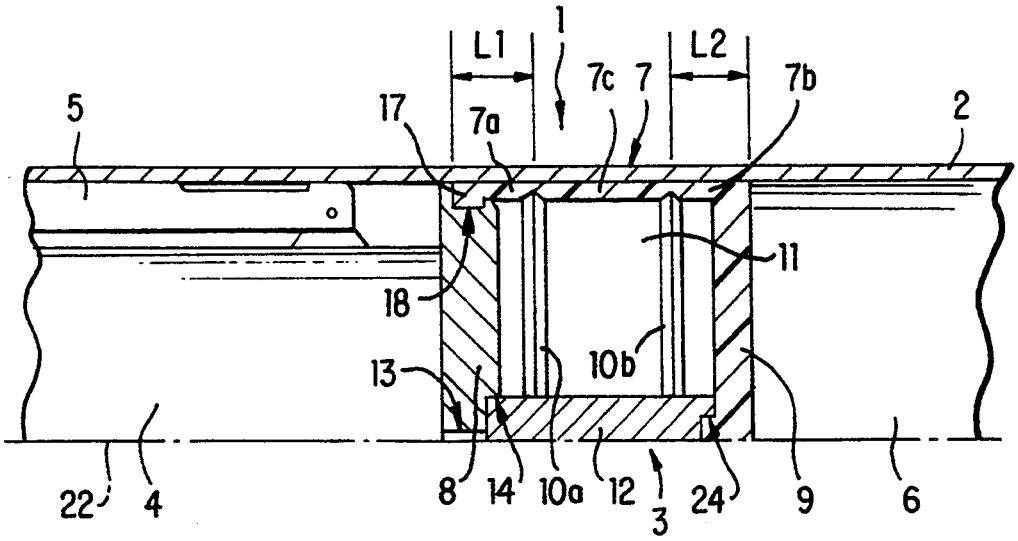
FIG. 4 is a partial schematic half cross-sectional view of a weapon including another housing embodiment according to the invention.

FIG. 4 shows another propellant charge housing embodiment according to the invention. As in previous embodiments, housing 3 has cylindrical casing 7 closed by two side walls. Bottom wall 9 is formed in a single piece with the casing, and lid 8 constitutes the second side wall. Casing 7 and bottom wall 9 preferably are made of a flexible plastic with a high elongation factor, for example, polyethylene. The lid is preferably made of an aluminum alloy.

Internal shoulder 17 of casing 7 fits into peripheral recess 18 of lid 8, linking casing 7 and lid 8. Internal space 11 receives the propellant charge.

Igniter 12, preferably of the black powder type, is disposed in space 11 at axis 22 of weapon 1 and housing 3. Igniter 12 fits into first recess 14 provided on lid 8 and rests on stub 24, which is integral with bottom 9 of housing 3.

In this embodiment, casing 7 has two annular scores 10*a*, 10*b*. Each score is disposed in the vicinity of a side wall 8, 9. Scores 10*a*, 10*b* delimit three parts on cylindrical casing 7: front part 7*a*, abutting lid 8, rear part 7*b*, abutting bottom wall 9, and median part 7*c*. Scores 10*a*, 10*b* are disposed such that length L1 of front part 7*a* is substantially equal to length L2 of rear part 7*b* of casing 7.

When the propellant charge is triggered, the increase in pressure inside the housing strongly applies casing 7 against the inner surface of barrel 2. The pulling forces that appear inside casing 7 cause casing 7 to break at the two scores 10*a*, 10*b*.

Figure 5:
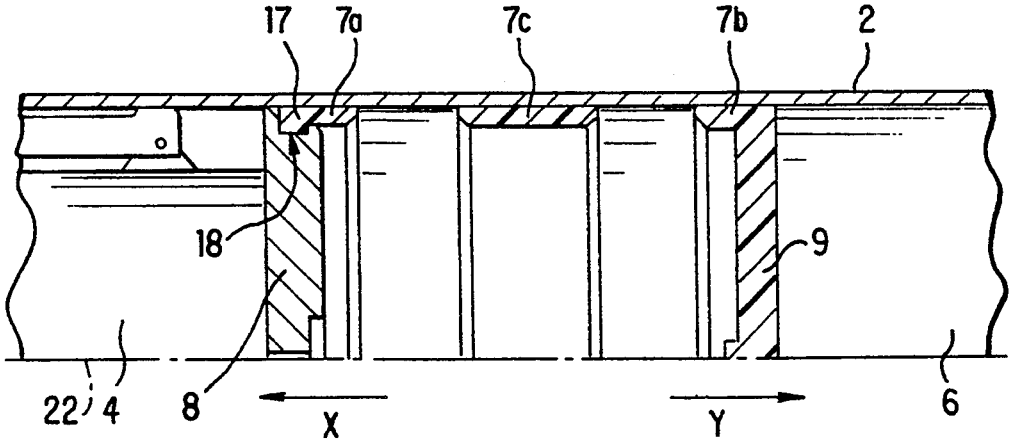
FIG. 5 is a view of the FIG. 4 device after triggering the propellant charge.

FIG. 5 shows the weapon at the time of this separation. The pressure of the gases pushes the projectile in direction X by means of lid 8, which carries front part 7*a* of casing 7. The pressure also pushes counterweight 6 in direction Y by means of bottom wall 9, which is integral with rear part 7*b* of casing 7. Median part 7*c* of casing 7 remains applied to the barrel wall.

This embodiment allows the values of lengths L1 and L2 to be limited (to 5 and 10 mm, for example), decreasing the frictional forces between barrel 2 and front part 7*a* and rear part 7*b* of casing 7 and avoiding the risk of breaking at points other than scores 10*a*, 10*b*. This embodiment also ensures the reproducibility of the location of scores 10*a*, 10*b* of casing 7, even when housing 3 is of substantial length (greater than or equal to its diameter, for example).

Figure 6:
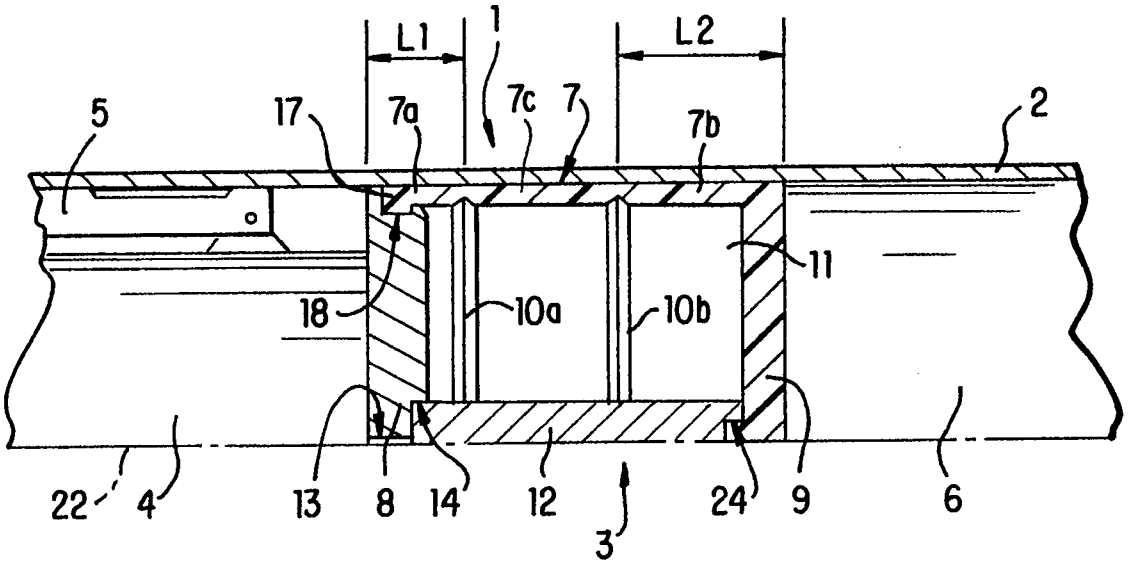
FIG. 6 is a partial schematic half cross-sectional view of a weapon including another housing embodiment according to the invention.

Also in this embodiment, changing the values of L1 and L2 obtains different frictional forces between barrel 2 and casing 7 for the front and rear parts 7*a*, 7*b* of casing 7. It is possible, therefore, to regulate the recoil forces of a given weapon. FIG. 6, for example, shows housing 3 in which length L2 is twice length L1. The frictional force of rear part 7*b* on barrel 2 is then double that of front part 7*a*. This difference allows compensation for parasitic friction, due, for example, to the nature of projectile 4, and allows cancellation of the recoil forces. Determining lengths L1, L2 will occur on a case-by-case basis, according to the characteristics of the weapon to be defined.

It is possible, without departing from the framework of the invention, to provide several variants incorporating the key features of the invention. Thus, it is possible to equip the cylindrical casing of a housing of the type described in WO 92/06344 with two scores.

Figure 7:
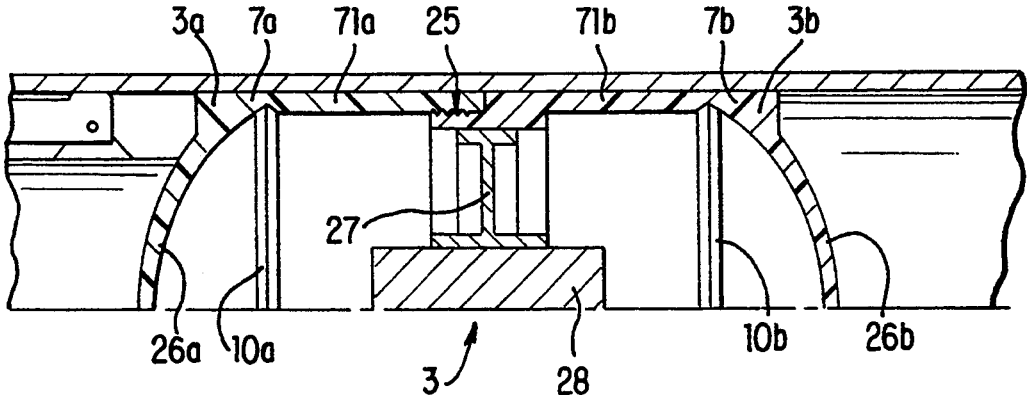
FIG. 7 is a partial schematic half cross-sectional view of a weapon including another housing embodiment according to the invention.

FIG. 7 represents such a variant. Housing 33 is made of two half-housings 3*a*, 3*b*, joined by thread 25. The bottom of each half-housing 3*a*, 3*b* constitutes a side wall 26*a*, 26*b*. A propellant charge is disposed in sheath 28, located at the housing axis, and is held by spacer 27 resting on the internal surface of half-housing 3*b*.

Half-housings 3*a*, 3*b* have cylindrical casings 71*a*, 71*b*, on which scores 10*a*, 10*b* are respectively provided. Each score 10*a*, 10*b* is disposed in the vicinity of a different side wall 26*a*, 26*b*. Scores 10*a*, 10*b* are preferably obtained by thinning casings 71*a*, 71*b*.

As in the above examples, this arrangement allows the breaking forces of the casing, under the effect of gas pressure, to be controlled and reproduced. The link between half-housings 3*a*, 3*b*, therefore, can be made rigid.

Figure 8:
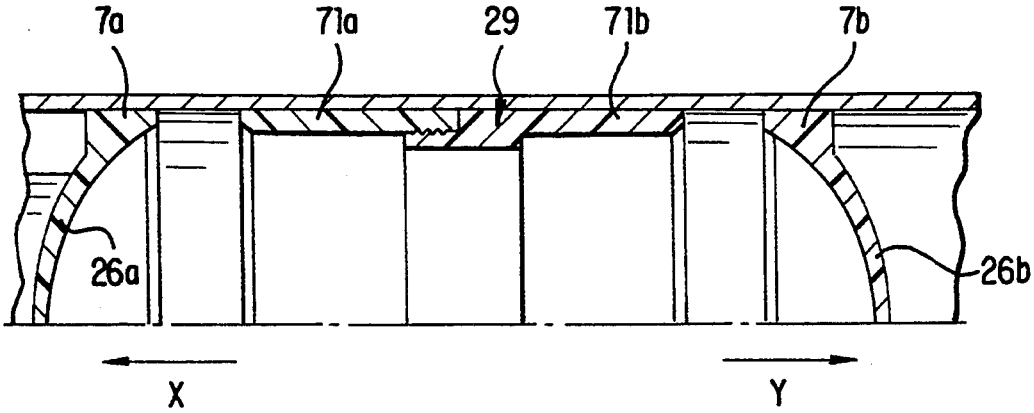
FIG. 8 is a view of the FIG. 7 device after triggering the propellant charge.

As shown in FIG. 8, after the propellant has been triggered, housing 3 is divided into three elements: 1) a front element, composed of side wall 26*a* and casing part 7*a*, which pushes the projectile in direction X, 2) a rear element, composed of side wall 26*b* and casing part 7*b*, which pushes the counterweight in direction Y, and 3) a median element 29, which remains applied to the barrel wall and which is formed of the casing residues of each half-housing 3*a*, 3*b* connected by thread 25.

Figure 9:
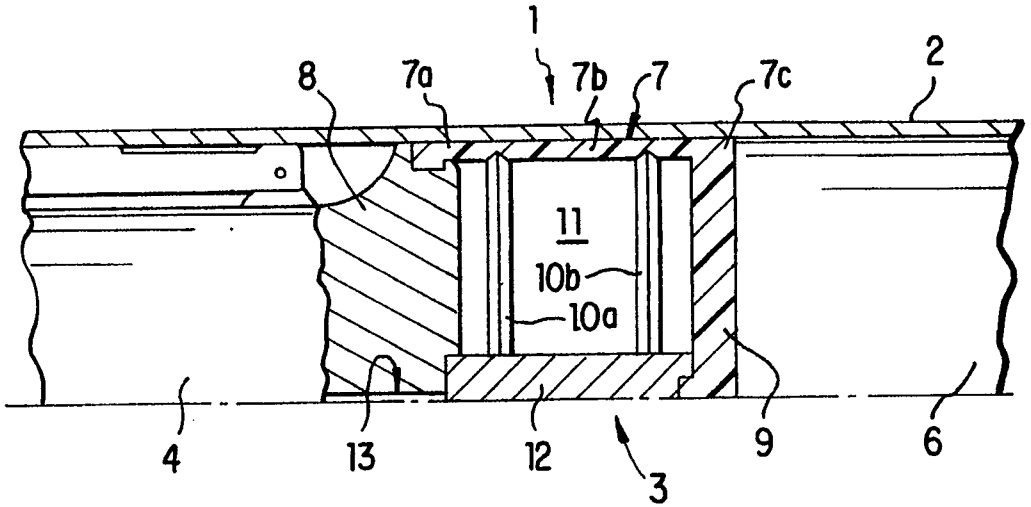
FIG. 9 is a partial schematic half cross-sectional view of a weapon including another housing embodiment according to the invention.

FIG. 9 represents another variant according to the invention, in which housing 3 is closed by lid 8, which is formed by the rear of projectile 4. This arrangement facilitates assembly of weapon 1, because projectile 4, carrying the propellant charge housing, constitutes a subassembly. At the exit of barrel 2 of weapon 1, aerodynamic stresses cause ejection of casing part 7*a*, which, hence, does not perturb the trajectory of projectile 4.

What is claimed is:

1. A propellant charge housing for loading into a weapon barrel, the housing comprising:

a cylindrical casing slidably fit within the barrel and having at least one annular score, the casing being of minimum thickness at the score and extending continuously across the score; and at least two side walls for delimiting the casing;

wherein the propellant charge causes the casing to break, at the at least one annular score, into at least two casing parts so that the housing is divided into at least two housing elements that are freely movable relative to each other, each housing element comprising one of the at least two casing parts; and wherein the propellant charge urges each casing part against the barrel so that a gas-tight seal is established between each casing part and the barrel.

2. A housing according to claim 1, wherein said casing is integrally formed of one piece before the propellant charge causes the casing to break into said casing parts.

3. A housing according to claim 1, wherein said casing has two scores, each score being disposed adjacent a respective one of the two side walls.

4. A housing according to claim 1, wherein the at least one score is formed by thinning the cylindrical casing.

5. A housing according to claim 1, wherein the at least two casing parts include a front casing part and a rear casing part, the score being disposed on the casing so as to delimit the front casing part and the rear casing part.

6. A housing according to claim 5, wherein the front casing part and the rear casing part are of substantially equal length.

7. A housing according to claim 1, wherein a wedging cup for wedging the propellant charge is disposed within the housing.

8. A housing according to claim 7, wherein the wedging cup is formed of compressible foam.

9. A housing according to claim 1, wherein the casing is formed of a flexible plastic material.

10. A housing according to claim 9, wherein the plastic material has a high elongation factor and a low coefficient of friction.

11. A housing according to claim 1, wherein an igniter for triggering the propellant charge is disposed within the housing.

12. A housing according to claim 11, wherein the igniter is disposed along a central axis of the housing.

13. A housing according to claim 11, wherein at least one of the side walls includes at least one recess, the igniter fitting into said at least one recess.

14. A housing according to claim 1, wherein one of the side walls comprises a lid, the lid being linked to the casing.

15. A housing according to claim 14, wherein the lid comprises a peripheral recess and the casing comprises an internal shoulder, the shoulder of the casing fitting into the recess of the lid to attach the casing to the lid.

16. A housing according to claim 14, wherein one of the side walls is integrally formed as one piece with the casing.

17. A housing according to claim 14, further comprising a projectile for discharge from the weapon, the projectile having a rear part that forms said lid.

18. A propellant charge housing for loading into a weapon barrel, the housing comprising:

two half-housings, each half-housing comprising a cylindrical casing slidably fit within the barrel, each casing having at least one annular score; and at least one side wall for delimiting the casing of each half-housing;

wherein the propellant charge causes each casing to break, at the at least one annular score of each casing, into at least two casing parts so that the housing is divided into at least two housing elements that are freely movable relative to each other, each housing element comprising one of the at least two casing parts; and wherein the propellant charge urges each casing part against the barrel so that a gas-tight seal is established between each casing part and the barrel.

19. A housing according to claim 18, wherein said casing is integrally formed of one piece before the propellant charge causes each casing to break into said at least two casing parts.

20. A propellant charge housing for loading into a weapon barrel, the housing comprising:

a cylindrical casing slidably fit within the barrel and having at least two annular scores; and at least two side walls for delimiting the casing;

wherein the propellant charge causes the casing to break, at the at least two annular scores, into at least two casing parts so that the housing is divided into at least two housing elements that are freely movable relative to each other, each housing element comprising one of the at least two casing parts; and wherein the propellant charge urges each casing part against the barrel so that a gas-tight seal is established between each casing part and the barrel.

21. A propellant charge housing for loading into a weapon barrel, the housing comprising:

a cylindrical casing slidably fit within the barrel and having at least one annular score; and at least two side walls for delimiting the casing, one of the side walls comprising a lid linked to the casing;

wherein the propellant charge causes the casing to break, at the at least one annular score, into at least two casing parts so that the housing is divided into at least two housing elements that are freely movable relative to each other, each housing element comprising one of the at least two casing parts; and wherein the propellant charge urges each casing part against the barrel so that a gas-tight seal is established between each casing part and the barrel.

22. A propellant charge housing for loading into a weapon barrel, the housing comprising:

a cylindrical casing slidably fit within the barrel and having at least one annular score; and at least two side walls for delimiting the casing;

wherein the propellant charge causes the casing to break, at the at least one annular score, into at least two casing parts so that the housing is divided into at least two housing elements that are freely movable relative to each other, each housing element comprising one of the at least two casing parts;

wherein the propellant charge urges each casing part against the barrel so that a gas-tight seal is established between each casing part and the barrel; and wherein a wedging cup for wedging the propellant charge is disposed within the housing.

23. A propellant charge housing for loading into a weapon barrel, the housing comprising:

a cylindrical casing slidably fit within the barrel and having at least one annular score; and at least two side walls for delimiting the casing;

wherein the propellant charge causes the casing to break, at the at least one annular score, into at least two casing parts so that the housing is divided into at least two housing elements that are freely movable relative to each other, each housing element comprising one of the at least two casing parts; and wherein the propellant charge urges each casing part against the barrel so that a gas-tight seal is established between each casing part and the barrel;

wherein an igniter for triggering the propellant charge is disposed within the housing; and wherein at least one of the side walls includes at least one recess, the igniter fitting into said at least one recess.

* * * * *